US009908671B2

(12) United States Patent
Besson et al.

(10) Patent No.: US 9,908,671 B2
(45) **Date of Patent: *Mar. 6, 2018**

(54) LIQUID FILLED BOTTLE HAVING A COVER MEMBER WITH A LABEL FORMING EXTENSION

(75) Inventors: Jean-Paul Besson, Abondance (FR); Christine Gehringer, Vinzier (FR)

(73) Assignee: SA DES EAUX MINERALES D'EVIAN SAEME, Evian-les-Bains (FR)

( * ) Notice: Subject to any disclaimer, the term of this patent is extended or adjusted under 35 U.S.C. 154(b) by 889 days.

This patent is subject to a terminal disclaimer.

(21) Appl. No.: 14/125,453

(22) PCT Filed: Jun. 11, 2012

(86) PCT No.: PCT/EP2012/060976

§ 371 (c)(1),
(2), (4) Date: Dec. 11, 2013

(87) PCT Pub. No.: WO2012/168471

PCT Pub. Date: Dec. 13, 2012

(65) Prior Publication Data

US 2014/0144868 A1 May 29, 2014

(30) Foreign Application Priority Data

Jun. 10, 2011 (WO) ..... PCT/IB2011/001676

(51) Int. Cl.
*B65D 23/14* (2006.01)
*B65D 51/24* (2006.01)
*B65D 77/20* (2006.01)

(52) U.S. Cl.
CPC ..... *B65D 51/245* (2013.01); *B65D 23/14* (2013.01); *B65D 77/2032* (2013.01); *B65D 2203/02* (2013.01)

(58) Field of Classification Search
CPC ..... B65D 23/14; B65D 3/12; B65D 51/245
(Continued)

(56) References Cited

U.S. PATENT DOCUMENTS 2,007,685 A * 7/1935 Lyle ..... G09F 3/04 40/310
4,280,653 A * 7/1981 Elias ..... B65D 3/22 215/233
6,308,853 B1 * 10/2001 Jud ..... B65D 77/20 156/277

FOREIGN PATENT DOCUMENTS

DE 20 2008 010071 U1 12/2008
DE 20 2010 009034 U1 9/2010
(Continued)

OTHER PUBLICATIONS

International Search Report, dated Jul. 9, 2012, from corresponding PCT application.

*Primary Examiner* — Anthony Stashick
*Assistant Examiner* — Raven Collins
(74) *Attorney, Agent, or Firm* — Young & Thompson

(57) ABSTRACT

The liquid filled bottle includes a plastic bottle (1) and a cover member (C) sealing an opening (5) of the bottle, the cover member (C) including: —a closing portion (6) sealing the opening (5) of the bottle (1) in an annular area (6*a*), the closing portion having a circumference (8) defined by an outer edge of the annular area, the closing portion defining a first surface (S1) that is substantially planar and delimited by the circumference; and —a label portion (10) that defines a second surface (S2), the label portion (10) and the closing portion (6) being parts of a single piece foil, for instance a flexible plastic foil. The second surface (S2) is entirely offset relative to the annular area (6*a*), the ratio between the second surface (S2) and the first surface (S1) being at least 1:2, and preferably at least 1:1.

20 Claims, 4 Drawing Sheets

(58) Field of Classification Search
USPC ..... 215/230
See application file for complete search history.

(56) References Cited

FOREIGN PATENT DOCUMENTS

| | | |
|---|---|---|
| EP | 0 657 201 A | 6/1995 |
| EP | 0 761 560 A1 | 3/1997 |
| FR | 2 101 015 A1 | 3/1972 |

* cited by examiner

LIQUID FILLED BOTTLE HAVING A COVER MEMBER WITH A LABEL FORMING EXTENSION

FIELD OF THE INVENTION

The present invention relates to containers provided with a narrow opening and having a cover member, which are used in food or non food packaging industry, particularly to plastic bottles or similar.

BACKGROUND OF THE INVENTION

Bottles of this type have to satisfy various constraints associated with their transport and the pouring convenience for the user while having to be as light as possible in order to reduce costs associated with the quantity of plastic material used or with its transportation, and to reduce the impact on the environment. The food industry in particular has to propose packagings inexpensive and which generate as less as possible wastes.

In order to obtain pouring convenience for the user, even when pouring the liquid into a cup of small capacity (typically less than 300 mL), the largest dimension of the narrow opening is generally inferior to 40 mm and typically inferior to 30 mm. Accordingly, a narrow opening means in the present specification an opening having its largest dimension inferior to 40 mm. Such a narrow opening is especially well adapted for direct drinking or for pouring the content of the bottle in a water cup having a maximum diameter inferior to 80 mm.

Document EP 0 761 560 A1 discloses a receptacle whose neck is closed by a rectangular capsule and comprises an outer thread allowing use of a screw cap. The rectangular capsule comprises a closing portion heat sealed onto a ring defined at the top of the neck and having a disk-like shape. In the respective corners of the rectangular capsule, two tips are folded along the neck and fixed by heat sealing, while two other tips extend in the same plane as the closing portion and may be used to remove the capsule. Receptacles such a those disclosed in EP 0 761 560 A1 are provided with a sleeve label arranged around the body of the receptacle to display information about the content to the user.

Such receptacles still contain a significant amount of plastic material. A need thus still exists for developing liquid filled bottles with less plastic material and/or optimizing the use of plastic material in such sealed receptacles, and/or simplifying manufacturing processes.

SUMMARY OF THE INVENTION

A general object of the present invention is to provide liquid filled bottles with an improved use of the plastic material.

To this end, embodiments of the present invention provide a liquid filled bottle, comprising a cover member and a plastic bottle having a body and an opening sealed by the cover member, the cover member comprising:

- a closing portion comprising a peelable foil sealing the opening of the bottle in an annular area, the closing portion having a circumference defined by an outer edge of said annular area, the closing portion defining a first surface that is substantially planar and delimited by said circumference; and
- a label portion that defines a second surface, the label portion and the closing portion being parts of a single piece foil;

wherein the second surface is entirely offset relative to said annular are and the ratio between the second surface and the first surface is at least 1:2. The second surface can display label information, for instance about the composition and origin of the liquid content of the bottle.

The bottle preferably has a narrow opening. By narrow opening, it is meant that the dimension of the opening is lower than the largest dimension of the body and/or that the dimension of the opening is inferior to 40 mm, preferably inferior to 30 mm).

Advantageously, one single piece of plastic material is provided for both sealing the bottle and displaying information, whereby the sleeve label becomes optional. This disposition with one single foil enhances the integrity of the label portion, limiting the risk of tearing or degrading the label portion (information displayed on the label portion being easy to read after removal of the cover member). Also the manufacturing process can be simplified, as the step of applying the sleeve can be omitted.

For bottles of small capacity (for instance between 150 and 500 mL), the label information can be easily read when the bottle 1 is taken by hand in the gripping portion, while information displayed on a conventional sleeve label is masked by the hand. Furthermore, the neck 4 may be of reduced height, without any thread. The height of the neck 4 thus may be inferior or equal to 10 mm for instance.

Preferably, the ratio between the second surface and the first surface is at least 1:1. Accordingly, when the label portion is formed as a side extension of the closing portion, the label portion has a circumference which may be at least equal to the circumference of the closing portion and all or part of label information can be significantly offset relative to the annular area.

In various embodiments of the bottle of the invention, recourse may optionally also be had to one or more of the following dispositions:

- the single piece foil has a maximal thickness inferior or equal to 300 μm, and the thickness is preferably constant; this maximal thickness is comprised between 5 and 200 μm for instance, and preferably between 10 and 150 μm, and even more preferably between 20 and 50 μm;
- the body of the bottle extends around a longitudinal axis, the closing portion being a top portion that intersects this longitudinal axis;
- the body determines an imaginary cylinder extending longitudinally around said longitudinal axis, the closing portion being within said imaginary cylinder and the label portion protruding beyond this imaginary cylinder;
- the label portion comprises a free end that entirely extends outside said imaginary cylinder (the free end can optionally be pasted on the bottle and may entirely extend outside said imaginary cylinder when it is not pasted);
- the label portion comprises a free end, the distance between said free end and said longitudinal axis being superior to the diameter of said imaginary cylinder;
- the cover member further comprises a tab extending from the closing portion and having a free end that extends at a distance from the label portion;
- the tab has a length sufficient to allow the closing portion to be peeled off remotely by pulling the free end of the tab, this free end being arranged within said imaginary cylinder;
- the closing portion defines a substantially disc-shaped crown having a determined diameter;

the label portion comprises a free end provided with an edge having a length superior or equal to said determined diameter;

the neck comprises a ring, on which the closing portion is fixed by heat sealing;

the closing portion essentially extends in a first plane, the cover member comprising a junction portion adjacent said ring and arranged between the closing portion and the label portion along a fraction of the circumference of the closing portion;

the label portion extends in a second plane intersecting the first plane at the junction portion;

the junction portion is arranged between two notches to form a hinge;

the fraction of the circumference is superior or equal to 1:12, and preferably comprised between 1:6 and 1:2;

the label portion has two opposite sides, preferably rectilinear, each extending between the junction portion and the free end;

the single piece foil is marked with at least one of ink printing and engraving on said second surface, whereby the label portion displays label information;

the single piece foil is marked with ink printing on two second surfaces defined on two respective opposite faces of said label portion.

only one label defined by said label portion is provided, the body being transparent and not covered by any additional layer of material.

the bottle can be a 150 mL, 200 mL, 250 mL, 330 mL, 500 mL, 750 mL, 1 L or 1.5 L bottle.

the bottle material can be a PolyEthylene Terephtalate (PET) material.

the foil can comprise a PET material, for example a PET film optionally covered by a lacquer, preferably with a thickness between 10 and 150 μm, preferably between 20 and 50 μm.

the bottle material can be a PolyEthylene Terephtalate (PET) material with the foil comprising a PET material, for example a PET film optionally covered by a lacquer (using PET materials for the bottle and the cover allows a simplified recycling).

A method is also provided for manufacturing a packaging comprising a bottle filled with a liquid and sealed by a cover member. The method comprises:

providing a planar single-piece foil having a central portion that defines a first surface and a peripheral portion that defines a second surface, the ratio between the second surface and the first surface being at least 1:2, and preferably at least 1:1;

marking label information onto the second surface of the peripheral portion, at a distance from the central portion;

providing a liquid filled bottle, the liquid being filled through an opening;

sealing the opening of said bottle by fixing the central portion directly onto an annular area of the bottle surrounding the opening, so that the peripheral portion defines a label portion extending at a distance from the opening.

In various embodiments of the process of the invention, recourse may optionally also be had to one or more of the following:

the bottles can made by injection blow molding, preferably by injection stretch blow molding.

the planar single-piece foil is cut before the fixing and sealing operation, and preferably after marking label information.

the bottles may be filled with a liquid beverage, for instance a still liquid beverage and preferably mineral water.

DETAILED DESCRIPTION OF EMBODIMENTS

In the various figures, the same references are used to designate identical or similar elements.

Figure 1:
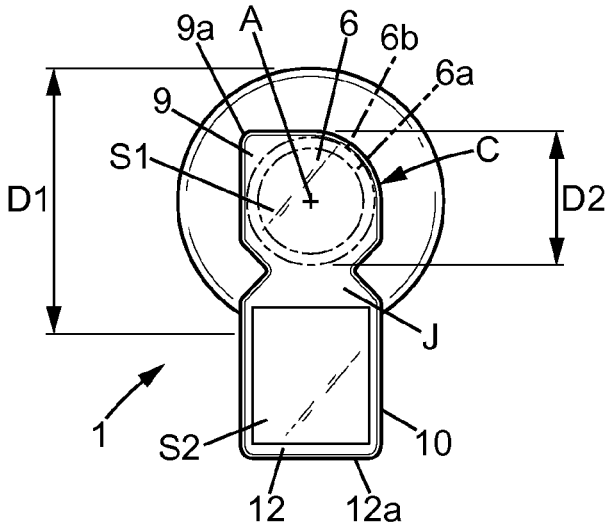
FIG. 1 is a top view of a liquid filled bottle in accordance with a first embodiment of the invention.
Figure 3:
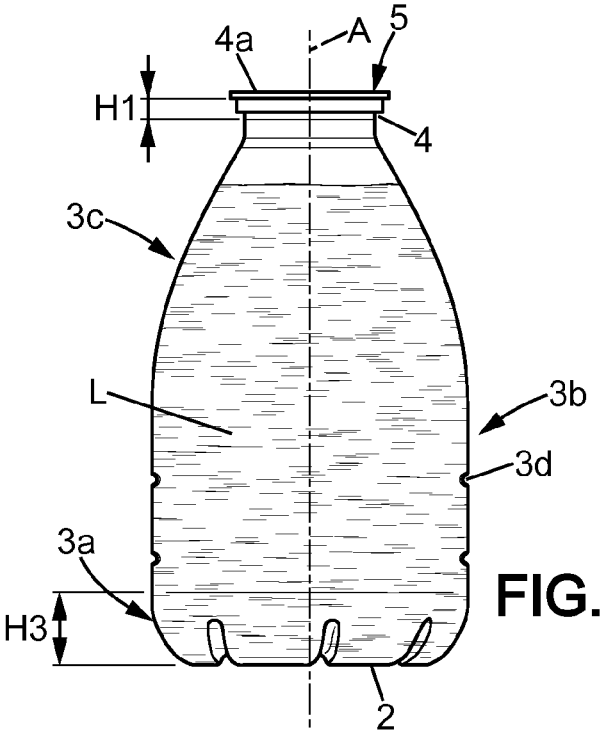
FIG. 3 shows a transparent plastic bottle filled with the liquid, before sealing by the cover member, the plastic bottle being adapted to be used in accordance with the first embodiment of the invention.

Referring to FIGS. 1 and 3, the liquid filled bottle comprises a bottle 1 having a bottom 2 from which a body 3 extends longitudinally along a longitudinal axis A to a neck 4 which ends in a ring 4*a* forming a pouring opening 5. The body 3 has, from its base to its top, the bottom 2, a lower portion 3*a*, a gripping portion 3*b* and an upper portion 3*c* forming a shoulder of the bottle 1. The neck 4 is arranged as an extension of the upper portion 3*c* and here also extends longitudinally around the longitudinal axis A. This configuration is preferred because this prevents risks of breakage at the neck area during transport and the bottles 1 can be packaged with minimized empty spaces between them. Here, the body 3 has a tubular shape with a substantially circular cross-section and the longitudinal axis A may be a vertical central axis. However, it should be understood that other shapes may be provided and the neck 4 could be provided as a lateral extension of the body. The neck 4 is covered by a closing portion 6 of a cover member C.

For comfortable pouring of the liquid L with a bottle 1 of more than 1-liter capacity, it is preferable if the gripping portion 3*b* is located above half-height of the bottle 1 but below three quarters of its total height. For bottles of lower capacity, height H3 of the lower portion 3*a* may be reduced as shown in FIG. 3. Here, the gripping portion 3*b* has a form of a cylinder, while the upper portion 3*c* is tapered toward the neck 4. The height H1 of the neck 4 is inferior to 10 mm. Referring to FIG. 3, the height H1 of the neck 4 is inferior to 10% of the total height of the bottle 1, whose capacity is here comprised between 150 and 400 mL.

In this case, the bottle 1 may be formed from a single piece of plastic material, PET in the embodiment shown, which is shaped by heat blow-molding a preform in a mold. Heat blow-molding makes it possible to stretch the plastic material biaxially and to provide it with rigidity. Heat blow-molding also makes it possible to reduce the thickness of the wall of the body 3 considerably in relation to the thickness of the wall of the preform. This small thickness of the walls of the body 3 of the bottle 1, which may be of the order of 100 to 300 micrometers depending on the zone considered, is important for achieving a saving in material and therefore in weight.

The long shape of the body 3 may be obtained by a stretch blow molding process. The neck 4 is a part present on the preform, which part is not modified during the operations of transforming the preform into a bottle 1.

Still referring to FIGS. 1 and 3, the neck 4 is here provided without any thread and thus can be of reduced height. The neck 4 can be closed by a foil or similar thin layer of a flexible material, using a fixing material (layer of adhesive) deposited on the top annular surface defined by the ring 4*a* and/or using heat sealing, or deposited on the foil.

Figure 2:
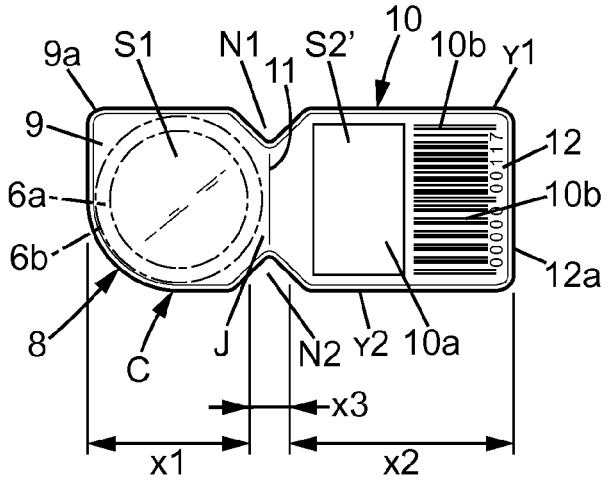
FIG. 2 shows the cover member of FIG. 1.

Now referring to FIG. 2, the liquid filled bottle 1 is provided with a cover member C made from a foil material. The cover member C comprises a closing portion (as shown on the left part of FIG. 2) which entirely covers the ring 4*a* to seal the narrow opening 5. The cover member C is peelable. Pulling a peripheral portion allows removing the fixing annular area 6*a* of the closing portion from the ring 4*a*. The closing portion has a circumference 8 adjacent to the fixing annular area 6*a* (visible in particular in FIGS. 1 and 2). The circumference can be substantially defined by the outer edge 6*b* of this annular area 6*a*. Here, the circumference is circular but could also be rectangular, squared (varying with the shape of the neck 4).

The closing portion 6 defines a first surface S1 that is substantially planar and delimited by said circumference 8. An optional tab 9 extending from the closing portion 6 may be provided beyond the circumference of the closing portion.

In the first embodiment shown in FIGS. 1-2, the closing portion defines a substantially disc-shaped crown having a determined diameter D2. It can be seen that the free end 12 of the label portion 10 is provided with an edge 12*a* having a length superior or equal to this determined diameter D2.

Here, a label portion 10 having a rectangular shape is provided. The two opposite sides y1, y2 of the label portion 10 are rectilinear, each extending between a junction portion J and the free end 12 remote from the closing portion 6. As compared to a conventional tab provided with a free end 9*a*, the label portion 10 has more significant dimensions allowing display of information related to the composition and origin of the content or other relevant information. The free end 9*a* of the tab 8 here extends at a distance from the label portion 10, preferably in the opposite region. The label portion 10, the optional tab 9 and the closing portion 6 are parts of a single piece flexible foil having a maximal thickness not superior to 300 μm. There is no particular need for any additional stiffening layer in the preferred embodiments. In order to save material, this single piece foil may have a constant thickness not superior to 200 μm, and preferably not superior to 150 μm.

As shown in FIGS. 1-2, the label portion 10 defines a second surface S2, at least as large as the first surface S1, where label information is marked. This surface S2 is entirely offset relative to the annular area 6*a*. Accordingly, adequate visibility of the label information is obtained once the cover member C is fixed by its closing portion 6 onto the top of a liquid filled bottle 1. FIG. 2 shows the other face of the cover member C, where an additional second surface S2' is defined.

In the non-limitative example of the figures, the single piece foil is here marked with ink printing or any other marking technology on the second surface S2 and optionally on other surfaces S2' defined on at least one of the two respective opposite faces of the label portion 10.

In FIG. 2, it can be seen that the back of the label portion 10 may be partitioned into at least one area 10*a* with alphanumeric, pictograms and/or pictorial information and at least one area with coded information (for instance displaying a barcode 10*b*). The surface S2' displaying label information may extend on all or part of the back of the label portion 10.

Figure 4:
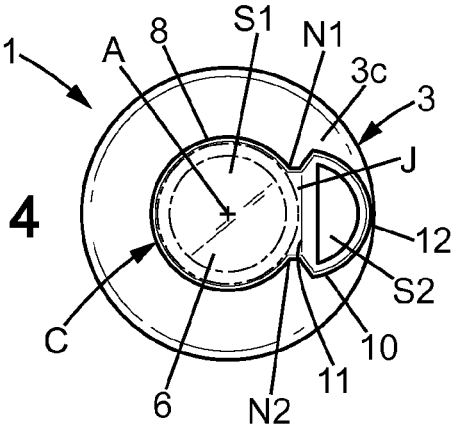
FIG. 4 is a top view of a liquid filled bottle in accordance with a second embodiment of the invention.

While FIGS. 1 and 2 show a label portion 10 of area at least equal to the area of the closing portion 6, a ratio about 1:2 between the surfaces S2 and S1 may also be satisfactory as shown in FIG. 4. In this second embodiment, the closing portion 6 is similar to the closing portion show in FIGS. 1 and 2 but the surface S2 defined by the label portion 10 is smaller. In this case, the barcode 10*b* could be removed from the top face of the label portion 10 (and possibly displayed on the other face).

In order to increase visibility of the label information displayed by the label portion 10, the cover member C may be provided with at least one and preferably two notches N1, N2. A junction portion J is arranged between the two notches N1, N2 to form a hinge 11 or a hinge area. The label portion 10 thus may be optionally inclined relative to a first plane in which the closing portion extends. In this case, the label portion 10 extends in a second plane intersecting the first plane at the junction portion J.

Of course, those skilled in the art will choose a width of the junction portion J, which is sufficient so that the cover member C can be removed without tearing. Preferably, the width of the junction J is not inferior to the half of the diameter D2.

With a folding of the label portion 10 relative to the closing portion 6, label information may be easily read from a lateral position. The label portion 10 can be considered as a loose flap with an angular deviation relative to the closing portion 6 (the angle being for instance comprised between 10 and 80°).

It can be seen in the first and second embodiments, as shown in FIGS. 1-2 and 4, that the junction portion J is adjacent to the ring 4 and arranged between the closing portion 6 and the label portion 10 along a fraction of the circumference 8 of the closing portion 6. Here, this fraction is a minoritary fraction so that the label portion 10 is formed as a side extension but, more generally, the fraction could be comprised between 1:12 and 1:1. In the examples of FIGS. 1-2, 4-6 and 8 this fraction is comprised between 1:6 and 1:2. In the example of FIG. 7 this fraction is slightly superior to 1:2, while in the example of FIG. 8 the junction portion J continuously surrounds the closing portion 6. A fraction above 1:12 corresponds to a good compromise, in order to avoid breakage of the label portion 10 during transport of the liquid filled bottle 1, while minimizing the thickness of the cover member C.

When fixed, the cover member C will be capable of containment of pressures which may be produced in the bottle 1 above the liquid L while enabling facile opening of said cover member C by pulling a tab 9 or the label portion 10 in a movement generally parallel to the longitudinal axis A.

The tensile strength of the plastic foil may be comprised for instance between 40 and 300 N/m$^2$, preferably between 50 and 200 N/m$^2$. More generally, the label portion 10 and the closing portion 6 (to be fixed as a top portion onto the top of the neck 4) are integrally formed in bendable sheet plastic. The plastic foil may be obtained using a flexible multilayer sheet plastic so that both faces of the label portion 10 may be marked with information, for instance by ink printing.

Now referring to FIGS. 1 and 5-9, the label portion 10 protrudes beyond the imaginary encasing body 13 determined by the body 3, which may have the form of a cylinder, cone, prism or pyramid. The neck 4 and the closing portion 6 here remain inside this imaginary encasing body 13 and the closing portion 6 intersects the longitudinal axis A. According to FIGS. 5 and 7, the body 3 determines an imaginary cylinder (this imaginary cylinder having no upper limit) or similar encasing body 13 that extends longitudinally around this longitudinal axis A without any upper limit. This configuration is also used in FIGS. 1, 6 and 8-9. The longitudinal axis A of the bottle body 3 is here a central axis of symmetry for both the body 3 and the neck 4. In this case, the imaginary encasing body 13 is a virtual cylinder having the same diameter D1 as the bottle body 3.

Regarding the example of FIG. 7, the body 3 which has a general squared cross-section is also inscribed in an imaginary cylinder and it can be seen that the label portion 10 protrudes from such an imaginary encasing body 13.

It can be seen in the FIGS. 1, 5-6 and 8-9 that the free end 12 of the label portion 10 entirely extends outside the imaginary cylinder. Alternatively, the free end 12 can be pasted on the bottle, thus extending at or near the periphery of the imaginary cylinder. With effect of gravity, the free end 12 of the label portion 10 extends under the level of the closing portion 6 and the label information may also be read from a position laterally offset relative to the bottle 1. Accordingly, as compared to information displayed on a top surface of a conventional screw cap, visibility form a lateral point of view is increased at least for information of the label portion 10 displayed adjacent to the free end 12 (eye-catching display without maximizing the label). This is especially true for bottles stored in store shelves or racks where the top of the bottles 1 is adjacent an upper plate.

Figure 5:
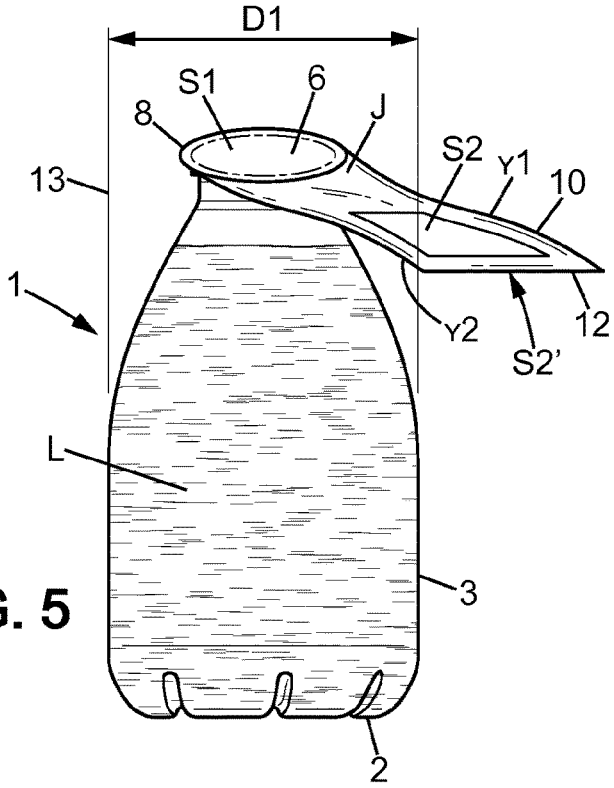
FIG. 5 shows a combination of the plastic bottle of FIG. 3 with a cover member, in accordance with a third embodiment of the invention.

With such a configuration of the cover member C, a liquid filled bottle 1 may be provided with only one label defined by said label portion 10. As a result, with a body 3 made of a transparent plastic material as shown in FIGS. 3 and 5, the liquid L is entirely visible through the walls of the body 3. In other words, the body 3 is not covered by any additional layer of material and a bottle can be produced with one step less. Should a need exist for adding more information, a sleeve label 14 can be provided as in the exemplary embodiment of FIG. 6. Alternatively or additionally, the label portion 10 may be enlarged near the free end 12 as shown in FIG. 6, in order to increase the useful surface S2 for displaying label information.

Referring to FIGS. 1-2, it should be understood that the optional tab 9 has a length sufficient to allow said closing portion 6 to be peeled off remotely by pulling the free end 9*a* of the tab 9 but have a size much smaller than the label portion 10. In particular, the free end 9*a* is arranged within the imaginary cylinder defined by the body 3. The bigger dimension of the tab 9 may be about 8 mm, while the distance x2+x3 as shown in FIG. 2 between the annular area 6*b* and the free end 12 of the label portion 10 is at least equal to 20 mm.

The closing portion 6 can have a circular shape or the like. The inner diameter (here substantially corresponding to the diameter of the opening 5) can be typically of higher than 12 mm, preferably higher than 15 mm, for example from 15 to 20 mm or from 20 mm to 25 mm, or from 25 mm to 30 mm. The annular area can have a width of from 1 to 15 mm, preferably from 2 to 10 mm, preferably from 3 to 5 mm. The outer diameter (typically defined by the edge 6*b*) can be of higher than 15 mm, preferably of higher than 20 mm, for example of from 20 to 23 mm, or of from 23 to 25.5 mm, or of from 25.5 to 27.5 mm, or of from 27.5 mm to 30 mm, or of from 30 mm to 35 mm. The fixing annular area 6*a* thus can have an outer perimeter higher than about 45 mm, preferably of higher than 60 mm. A large width can be useful in making the fixing easier.

Figure 6:
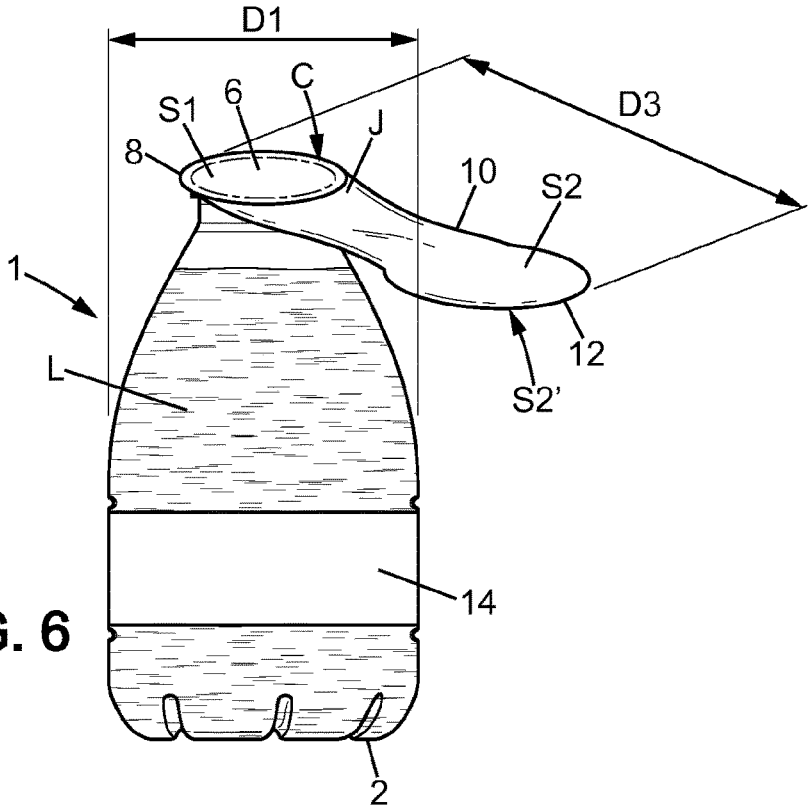
FIG. 6 shows a liquid filled bottle in accordance with a fourth embodiment of the invention.
Figure 7:
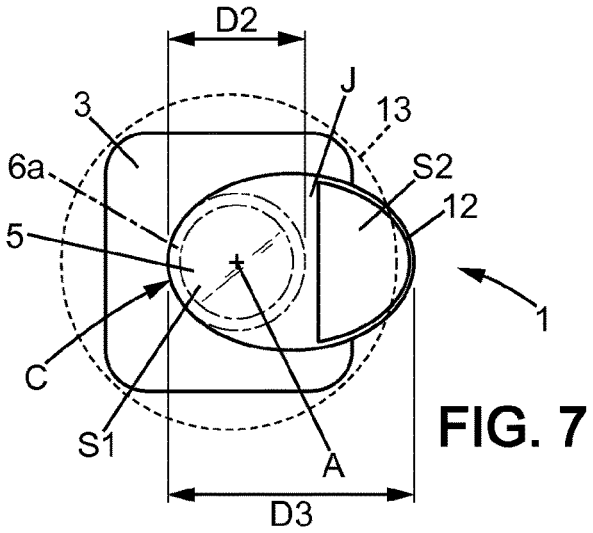
FIG. 7 is a top view of a liquid filled bottle in accordance with a fifth embodiment of the invention.

In the embodiments shown in FIGS. 1-2, 5-6 and 7-8, the label portion 10 has an elongated form, rectangular, elliptic or trapezoidal. Referring to FIG. 5-6, the length D3 of the label portion 10 is for instance superior or equal to the diameter D1 of the imaginary cylinder or similar imaginary encasing body 13. The distance between the free end 12 and the longitudinal axis also may be superior to the diameter D1.

Referring to FIG. 2, the characteristic size x1 of the closing portion 6, which may be equal to the diameter D1 when the ring 4*a* has a circular shape, is here not superior to the distance x2. As label information extends along this distance x2, the label portion 10 is particularly suitable to display all the composition data related to the content of the bottle 1. It can be seen that this configuration of the cover member C with an elongated label portion 10 is used in the embodiments shown in FIGS. 1-2, FIGS. 5-6 and 8. Alternatively as shown in FIGS. 4, 7 and 9, the distance x2 may be shorter with a length of the free end 12 which remains sufficiently high so that the label portion 10 has a size significantly higher than a tip-like tab 9 as shown in FIGS. 1-2.

Referring to FIG. 4, the cover member C has a smaller label portion 10 that is provided with a surface S2 (here visible from the top) at least equal to half of the surface S1 (also visible from the top) defined by the closing portion 6. This label portion 10 displays information and can be used to remove the cover member C. The free end 12 here does not protrude beyond the imaginary cylinder as above defined but is adjacent to such an imaginary cylinder.

In the third and fourth embodiments shown in FIGS. 5-6, the label portion 10 protrude as in the first embodiment beyond the cylindrical volume defined by the body 3 and comprises two rectilinear parallel sides y1, y2. The label portion 10 is formed as a side extension, the label portion 10 extending only toward one direction so that it would be possible to form a pack with rows of identical bottles 1, in which the respective label portions can be oriented in a general direction perpendicular to the general direction defined by the rows. The junction portion J is not defined between notches N1, N2 as in the first embodiment and the label portion 10 defines the lifting means for removing the cover member C (no additional tab 9 being provided).

The fourth embodiment of the liquid filled bottle 1 shown in FIG. 6 only differs from the third embodiment shown in FIG. 5 in that the free end 12 is enlarged and a sleeve label 14 is provided. Of course, the sleeve label 14 can be removed from the fourth embodiment or can be used in any one of the other embodiments.

Now referring to FIG. 7, a fifth embodiment is shown in which the body 3 has a generally squared cross-section, inscribed in an imaginary encasing body 13 that corresponds to a cylinder. The opening 5 is here circular but any other suitable shape could be used. For instance, the opening 5 could be triangularly shaped to form a spout.

The free end 12 of the label portion 10 protrudes beyond this imaginary encasing body 13. The cover member C made of the single piece foil has an elliptic shape with the long axis defining the length D3 of the cover member C. The closing portion 60 is arranged in a first half of the ellipse and the surface S2 for displaying label information is located in the second half, so that this second surface S2 is entirely offset relative to the annular area 6*a* used for the fixing of the cover member C. It can be seen that the ratio between the diameter D2 and the length D3 is here inferior to 2:3.

Figure 8:
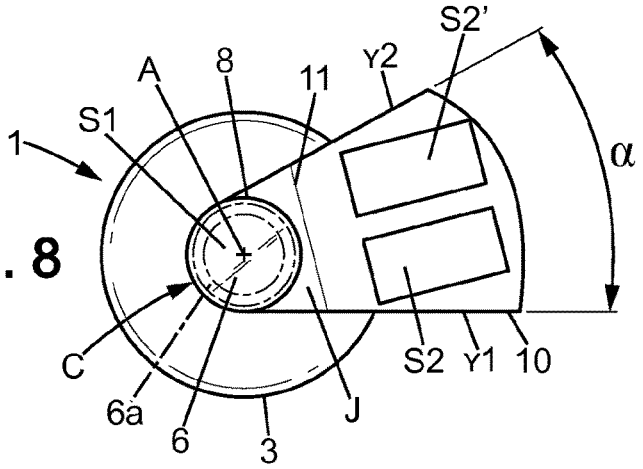
FIG. 8 is a top view of a liquid filled bottle in accordance with a sixth embodiment of the invention.
Figure 9:
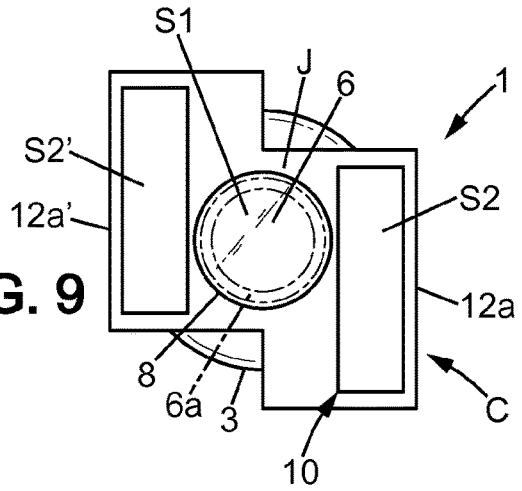
FIG. 9 is a top view of a liquid filled bottle in accordance with a seventh embodiment of the invention.

Referring to the sixth embodiment shown in FIG. 8, the cover member C is here provided with a label portion 10 which is tapered toward the longitudinal axis A. The free end 12 is enlarged and two significant areas or surfaces S2, S2' of the label portion 10 are used for displaying information. Use of at least two identical surfaces cane be useful for instance when two languages have to be used to display information (for instance in a country/state having two official languages).

Here, the rectilinear sides y1, y2 are convergent and define and angle α of approximately between 30 and 60°. More generally a cover member C with a label portion 10 extending along a large fraction of the circumference 8 of the closing portion 6 may be provided and an angle of at least 30° is defined when by the two opposite sides y1, y2. A hinge 11, rectilinear or curved, may be optionally defined at the junction portion J. Such a hinge allows folding of the label portion 10 without impact for the annular area 6*a*.

The free end 12*a* of the label portion 10 can be pasted on the bottle 1 through a removable fixing, for instance using a paste. The paste material may be fixed more strongly to one of the bottle and the label portion 10.

Referring to FIG. 9, a seventh embodiment is shown, in which the label portion 10 of the cover member C extends on two opposite sides of the closing portion 6. Two surfaces S2, S2' are thus defined near respective two free ends 12*a*, 12*a'* of the label portion 10. Should two languages be used to display information, this arrangement permits to modify placement of the bottle 1 (a first side for a first language and a second side opposite the first side for a second language). It should be understood that the label portion 10 may define a polygon with a plurality of outer rectilinear edges, ellipse or any suitable shape.

The present invention has been described in connection with the preferred embodiments. These embodiments, however, are merely for example and the invention is not restricted thereto. It will be understood by those skilled in the art that other variations and modifications can easily be made within the scope of the invention as defined by the appended claims, thus it is only intended that the present invention be limited by the following claims. Of course, the bottle 1 is not in any way limited to flat or sparkling mineral water but can be intended to contain all sorts of flowable products, edible or inedible liquids of greater or lesser fluidity such as, for example, fruit juices, milk-based beverages such as milk or dairy fermented products (for example yogurts), etc., and also sauces or condiments (ketchup, mustard, dressing, etc.) or non-food liquids (deionised water, cleaning products, detergents, etc.). The term "liquid" should thus not be interpreted in a restricted manner as the plastic container could be filled with any flowable product.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A liquid filled bottle, comprising a cover member and a plastic bottle having a body and a narrow opening sealed by the cover member, the cover member comprising:

a peelable closing portion extending entirely above a neck of the bottle and sealing the narrow opening of the bottle in an annular area, the peelable closing portion having a circumference defined by an outer edge of said annular area, the peelable closing portion defining a first surface that is substantially planar and delimited by said circumference; and a label portion that defines a second surface, the label portion and the peelable closing portion being parts of a single piece foil;

wherein the second surface is entirely offset relative to said annular area, the ratio between the second surface and the first surface being at least 1:2, wherein the plastic bottle comprises a neck to define the narrow opening, the neck comprising a ring, on which the peelable closing portion is fixed by heat sealing, and wherein the peelable closing portion essentially extends in a first plane, said cover member comprising a junction portion adjacent said ring and arranged between the peelable closing portion and the label portion along a fraction of the circumference of the peelable closing portion.

2. The liquid filled bottle according to claim 1, wherein the ratio between the second surface and the first surface is at least 1:1.

3. The liquid filled bottle according to claim 1, wherein said single piece foil has a maximal thickness inferior or equal to 300 μm.

4. The liquid filled bottle according to claim 3, wherein said single piece foil has a thickness, which is constant and is comprised between 5 and 200 μm.

5. The liquid filled bottle according to claim 1, wherein the body of the bottle extends around a longitudinal axis, the peelable closing portion being a top portion that intersects said longitudinal axis.

6. The liquid filled bottle according to claim 5, wherein the body determines an imaginary cylinder extending longitudinally around said longitudinal axis, the peelable closing portion being within said imaginary cylinder and the label portion protruding beyond said imaginary cylinder.

7. The liquid filled bottle according to claim 6, wherein said label portion comprises a free end, optionally pasted on the bottle, which entirely extends outside said imaginary cylinder when the free end is not pasted.

8. The liquid filled bottle according to claim 6, wherein said label portion comprises a free end, the distance between said free end and said longitudinal axis being superior to the diameter of said imaginary cylinder.

9. The liquid filled bottle according to claim 1, wherein the cover member further comprises a tab extending from the peelable closing portion and having a free end that extends at a distance from the label portion.

10. The liquid filled bottle according to claim 6, wherein the cover member further comprises a tab extending from the peelable closing portion, and wherein said tab has a length sufficient to allow the peelable closing portion to be peeled off remotely by pulling a free end of the tab, the free end of the tab being located within said imaginary cylinder.

11. The liquid filled bottle according to claim 1, wherein the peelable closing portion defines a substantially disc-shaped crown having a determined diameter.

12. The liquid filled bottle according to claim 11, wherein said label portion comprises a free end provided with an edge having a length superior or equal to said determined diameter.

13. The liquid filled bottle according to claim 1, wherein the label portion extends in a second plane intersecting the first plane at said junction portion.

14. The liquid filled bottle according to claim 1, wherein the junction portion is arranged between two notches to form a hinge.

15. The liquid filled bottle according to claim 1, wherein said fraction of the circumference is superior or equal to 1:12.

16. The liquid filled bottle according to claim 1, wherein said fraction is comprised between 1:6 and 1:2.

17. The liquid filled bottle according to claim 1, wherein the label portion has two opposite rectilinear sides, each extending between the junction portion and the free end.

18. The liquid filled bottle according to claim 1, wherein said single piece foil is marked with at least one of ink printing and engraving on said second surface, whereby the label portion displays label information.

19. The liquid filled bottle according to claim 18, wherein said single piece foil is marked with ink printing on two second surfaces defined on two respective opposite faces of said label portion.

20. The liquid filled bottle according to claim 1, only comprising one label defined by said label portion, the body being transparent and not covered by any additional layer of material.

* * * * *